United States Patent [19]

Fang

[11] 4,173,526

[45] Nov. 6, 1979

[54] CHLOR-ALKALI CELL DIAPHRAGM AND ITS TREATMENT

[75] Inventor: James C. Fang, Media, Pa.

[73] Assignee: E. I. Du Pont de Nemours and Company, Wilmington, Del.

[21] Appl. No.: 962,716

[22] Filed: Nov. 21, 1978

[51] Int. Cl.[2] ..... C25B 1/16; C25B 1/26; C25B 13/04

[52] U.S. Cl. ..... 204/296; 204/252; 204/295

[58] Field of Search ..... 204/296, 295, 252; 117/98

[56] References Cited

U.S. PATENT DOCUMENTS

| | | | |
|---|---|---|---|
| 3,238,056 | 3/1966 | Pall et al. | 117/98 |
| 3,849,243 | 11/1974 | Grot | 204/296 X |
| 3,989,615 | 11/1976 | Kiga et al. | 204/296 X |
| 4,003,818 | 1/1977 | Juillard et al. | 204/296 |
| 4,081,350 | 3/1978 | Kadija et al. | 204/295 X |
| 4,093,533 | 6/1978 | Beaver et al. | 204/295 X |

FOREIGN PATENT DOCUMENTS

| | | |
|---|---|---|
| 145482 | 12/1976 | Japan . |
| 156788 | 12/1977 | Japan . |

*Primary Examiner*—Arthur C. Prescott

[57] ABSTRACT

Magnesium compounds are added to chlor-alkali cell asbestos diaphragms, either initially or after some use, to improve electrical operating characteristics.

8 Claims, No Drawings

CHLOR-ALKALI CELL DIAPHRAGM AND ITS TREATMENT

BACKGROUND OF THE INVENTION

This invention relates to chlor-alkali cell diaphragms and to procedures for treating such diaphragms with magnesium compounds to improve their operating characteristics.

In the electrolysis of aqueous sodium chloride solutions or other brines to produce chlorine and caustic, one of the principal types of equipment used has a porous asbestos diaphragm separating the anode and cathode chambers. The anode can be provided as graphite, a dimensionally stable or adjustable metal anode or as other types known in the art. The cathode is typically a woven wire mesh screen. The diaphragm can be formed directly on the side of the cathode facing the anode chamber by vacuum deposition of asbestos and binders by techniques similar to those used in paper making. The deposited diaphragm is normally heated to fuse the binder.

The diaphragm must be porous enough to permit the flow of brine from the anode chamber into the cathode chamber under a small hydrostatic head of pressure. But it should also inhibit the diffusion of hydroxyl ions from the cathode chamber back into the anode chamber. The flow of the brine from the anode chamber to the cathode chamber aids in minimizing diffusion from the cathode chamber back into the anode chamber. Also, excessive leakage of hydrogen or chlorine gases through the diaphragm could contaminate the products being produced and require costly purification or even produce hazardous mixtures of the two gases. Although the nature of asbestos is not completely understood, it has been theorized that hydroxyl ion diffusion is inhibited by negative charges and a concentration of hydroxyl ions in the hydrated magnesium silicate at the surface of the asbestos. These features, combined with the chemical resistance of asbestos, make it a desirable component of chlor-alkali cell diaphragms.

However, chlor-alkali cell diaphragms made only or mainly of asbestos have a short life. The cathode chamber has a highly basic pH, such as 11–14, while the anode chamber has an acid pH, such as 3–5. Combined with the flow of brine through the diaphragm, these factors cause erosion and chemical and dimensional changes in an asbestos diaphragm, requiring replacement of the diaphragm when the cell becomes too inefficient.

Asbestos diaphragms have been improved by using various binders and modifiers. Fluorocarbon resins such as polytetrafluoroethylene (PTFE) and copolymers of tetrafluoroethylene and hexafluoropropylene, known as fluorinated ethylene-propylene (FEP), are effective as binders, due in part to their chemical inertness. Such polymers can be provided as an aqueous codispersion with asbestos from which the diaphragm is deposited. See U.S. Pat. No. 3,928,166—O'Leary et al. (1975) and U.S. Pat. No. 4,070,257—Motani et al. (1978). Fibers of such resins can also be used in the dispersions. Upon heating to fuse the fluorocarbon resin, the binder adheres to the asbestos in places, generally without completely coating the asbestos. Leaving much of the surface of the asbestos exposed is desirable since asbestos is hydrophilic, that is it wets readily, aiding the brine in flowing through the diaphragm, and it is thought that its surface characteristics can inhibit the back diffusion of hydroxyl ions.

In addition to such fluorocarbon resins which are hydrophobic, fluoropolymer resins containing hydrophilic functional groups such as carboxylic, sulfonic and phosphonic groups can be used as asbestos diaphragm modifiers. They can completely coat the asbestos, substituting their own functional groups for the surface charge and hydrophilic characteristics of the asbestos which then functions as a stable filler. Such resins can react with the asbestos rather than merely sticking to it, as discussed in Dutch Pat. No. 69/17096 (1970) and British Pat. No. 1,286,859 (1972), both to Grot, and U.S. Pat. No. 3,853,721—Darlington et al. (1974).

Each of the developments of the prior art is less than ideal. The fluoropolymer resins with functional groups are generally more expensive than fluorocarbon resins without the functional groups. Diaphragms with exposed asbestos remain subject to attack. Also, magnesium compound tends to be dissolved from the asbestos fibers themselves at the acid (anode) side of the diaphragm and be deposited as magnesium hydroxide on the basic (cathode) side of the diaphragm. This causes restrictions in the size of pores through the diaphragm and sooner or later can clog the pores to the point where the diaphragm is no longer useful. Alternatively, fine particle size magnesium hydroxide can be washed all the way through the diaphragm, leaving a silicate surface. Excessive flow rates and voltages can result. See "Fundamentals of Diaphragm Performance" by van der Heiden, pp. 33–40 of "Diaphragm Cells for Chlorine Productions—Proceedings of a Symposium Held at University City, London, England, June 16 and 17, 1976," published by the London Society of Chemical Industry, 1977.

U.S. Pat. No. 4,007,059—Witherspoon et al. provides a fuel cell diaphragm comprising asbestos, PTFE, FEP and alkaline earth metal oxide. However, such a fuel cell has a strongly basic environment throughout, and there is no flow of brine through the diaphragm as in a chlor-alkali cell.

SUMMARY OF THE INVENTION

The present invention provides a diaphragm for a chlor-alkali cell comprising asbestos and at least one magnesium compound selected from magnesium oxide, hydroxide, carbonate, oxyhalide and hydroxyhalide (wherein the halide is at least one of fluorine and chlorine), the magnesium compound being present in an amount of about 5–50%, preferably 35–45%, by weight based on the asbestos plus the magnesium compound. (Parts, proportions and percentages herein are by weight except where indicated otherwise.)

It also provides a process for treating a chlor-alkali cell diaphragm which comprises passing through the diaphragm a slurry containing a magnesium compound selected from magnesium oxide, hydroxide, carbonate, oxyhalide and hydroxyhalide (wherein the halide is at least one of fluorine and chlorine), and depositing such magnesium compound within the diaphragm.

DETAILED DESCRIPTION OF THE INVENTION

While the mechanism of the present invention is not fully understood, and applicant does not wish to be bound by any theory, it is thought that the magnesium compounds added to an asbestos diaphragm, either initially or after some operation of the chlor-alkali cell, rejuvenates or improves the operating characteristics of the asbestos. By stabilizing a desirable level of magnesium hydroxide throughout the cross-section of the diaphragm, any tendency of the magneisum hydroxide to leach out of the asbestos at the acid side of the diaphragm is counteracted. The hydrophilicity and surface characteristics of the diaphragm become more constant and reliable. Thus, the diaphragm can be used longer before replacement is required. Generally, diaphragms of the invention permit the use of lower voltage and give higher current efficiency than those of the prior art. Also, the treatment of the invention can be used to rejuvenate used diaphragms, especially ones that have begun to pass fluids too readily.

Magnesium compounds including the oxide and hydroxide seem to be unique in the extent of their insolubility in the environment of a chlor-alkali cell diaphragm. In contrast, other alkaline earth metal compounds such as beryllium oxides and hydroxides are much more soluble in caustic solutions; and calcium, strontium and barium oxides and hydroxides are more soluble in water.

A suitable form of magnesium oxide for use in the invention is U.S.P. grade 90, preferably having an average particle size, determined microscopically, about in the range of 0.1–10 μm, preferably 1.0–2.0 μm, with a relatively low bulk density and high surface area.

Chrysotile, preferably from Vermont white serpentine asbestos, is generally used in chlor-alkali cell diaphragms, including those of the invention. Preferably, a mixture of about equal weight quantities of fibers 0.5 and 5 cm long are used. Suitable commercial grades of asbestos are Vermont 3T and 4T and Johns-Manville 4D12 and Chlorbestos. However, other forms of asbestos such as blue amphibole may be useful in some circumstances.

Fluorocarbon polymers such as PTFE or FEP are generally used as binders in asbestos diaphragms of the invention. Diaphragms with such binders are sintered to soften the fluoropolymer adequately so that it sticks together and to the asbestos sufficiently to improve the performance and useful life of the diaphragm in a chlor-alkali cell.

Dispersion techniques known in the art can be used to disperse compositions of the invention and asbestos. Preferably 1–6% of a nonionic or anionic surfactant is employed, based on the solids in the dispersion. Vigorous stirring should provide enough energy to make a dispersion which is adequately stable for commercial purposes. A diaphragm is formed by drawing the dispersion through a screen to form a mat about 0.3–1 cm thick. This is an empirical art. The desired thickness of mat can be obtained by controlling the time after the mat has become dense enough that clear-appearing solution instead of cloudy dispersion is being drawn through the mat. It also can be helpful to control the slurry density. After the diaphragm has been formed, it is heated adequately to sinter the fluorocarbon polymer. If FEP is used, 1–2 hours at 350° C. is a desirable heat treatment. During drying, exposure to water and air, and electrolysis, the magnesium compounds will convert between magnesium oxide, hydroxide and carbonate. Magnesium oxyhalides and hydroxyhalides, including fluorides, chloride, and combinations thereof, will also undergo partial conversion to and from the other named magnesium compounds. If magnesium carbonate itself is used to make the diaphragm, $CO_2$ given off upon heating can aid in producing desirable porosity in the diaphragm. Also useful in the invention are Sorel cements of magnesium oxychloride, magnesium hydroxychloride and magnesium hydroxyfluoride.

The fluoropolymer is preferably a perfluorocarbon such as PTFE or FEP, such as Du Pont's "Teflon" FEP TE 9061 powder with an average particle size of 0.2–5 μm. However, perfluoro alkyl vinyl ethers, vinyl fluoride, vinylidene fluoride, fluorochlorocarbons and fluorobromocarbons and other fluoropolymers can also be used. As is known, a fluorocarbon polymer is composed of fluorine and carbon. A fluoropolymer may have other constituents.

COMPARATIVE TEST

Asbestos

Prepare a slurry of 3000 ml water, 290 g NaCl, 290 g NaOH, and 40.0 g 4D12 asbestos produced by Johns-Mansville Co., and sparge 1 h.

To prepare a wet diaphragm, pour the asbestos-polymer slurry into a 5-liter stainless steel beaker. Place a cathode screen in the beaker and connect to a vacuum set-up. Apply vacuum at 5 cm for 1 min, then 10 cm for 2 min, then 15 cm for 1 min, then 20 cm for 1.5 min. Remove the cathode from the beaker and allow it to dry under 51 cm vacuum for 20 min. Repair any holes with wet asbestos-polymer slurry from the beaker but with no compaction.

The wet diaphragm is allowed to dry overnight in air at 25° C. without baking. The weight of diaphragm was 12.4 g. The diaphragm was placed in the cell and run for 7 days at 8.3 A (182 A/dm$^2$) at 95° C. with a head of 24–55 cm to produce 2.1–2.26 N caustic at a flow rate of 125–146 ml/h. The initial voltage was 3.68, the final voltage was 3.38, and the current efficiency was 94–98%.

EXAMPLE

Using techniques basically the same as those of the comparative test but adding magnesium oxide U.S.P. grade 90 to the slurry in an amount of about 20% of the weight of the asbestos plus magnesium oxide, it was found that operating voltages of only about 3.10 could be used. This is a substantial improvement over the voltages of the comparative test.

What is claimed is:

1. A diaphragm for a chlor-alkali cell comprising asbestos and at least one magnesium compound selected from magnesium oxide, hydroxide, carbonate, oxyhalide and hydroxyhalide (wherein the halide is at least one of fluorine and chlorine), the magnesium compound being present in an amount of about 5–50% by weight based on the asbestos plus the magnesium compound.

2. The diaphragm of claim 1 wherein the magnesium compound is present in an amount of about 35–45% by weight based on the asbestos plus the mangesium compound.

3. The diaphragm of claim 1 wherein the magnesium compound is magnesium oxide having an average particle size about in the range of 1.0–2.0 μm.

4. The diaphragm of claim 1 which also contains a fluoropoylmer binder.

5. A process for treating a chlor-alkali cell diaphragm which comprises passing through the diaphragm a slurry containing a magnesium compound selected from magnesium oxide, hydroxide, carbonate, oxyhalide and hydroxyhalide (wherein the halide is at least one of fluorine and chlorine), and depositing such magnesium compound within the diaphragm.

6. The process of claim 5 wherein, before said treating, the diaphragm has been subjected to electrolysis in a chlor-alkali cell.

7. The process of claim 6 wherein the electrolysis has been sufficient to increase the operating voltage of the diaphragm and the treatment decreases the operating voltage for subsequent electrolysis.

8. The diaphragm of claim 4 wherein the fluoropolymer binder is a fluorocarbon polymer binder.

* * * * *